US005252910A

United States Patent [19]

Agaesse

[11] Patent Number: 5,252,910

[45] Date of Patent: Oct. 12, 1993

[54] CURRENT MIRROR OPERATING UNDER LOW VOLTAGE

[75] Inventor: Jean-Francois Agaesse, Voreppe, France

[73] Assignee: Thomson Composants Militaries et Spatiaux, Courbevoie, France

[21] Appl. No.: 904,569

[22] Filed: Jun. 26, 1992

[30] Foreign Application Priority Data

Jun. 27, 1991 [FR] France ..... 91 08007

[51] Int. Cl.[5] ..... G05F 3/24

[52] U.S. Cl. ..... 323/315

[58] Field of Search ..... 323/315, 316, 312; 330/288

[56] References Cited

U.S. PATENT DOCUMENTS

| | | | |
|---|---|---|---|
| 3,936,725 | 2/1976 | Schneider | 323/315 |
| 4,029,974 | 6/1977 | Brokaw | 323/315 |
| 4,300,091 | 11/1981 | Schade, Jr. | 323/315 |
| 4,327,321 | 4/1982 | Suzuki et al. | 323/315 |
| 4,471,292 | 9/1984 | Schenck et al. | 323/315 |
| 4,550,284 | 10/1985 | Sooch | 323/315 |
| 4,618,815 | 10/1986 | Swanson | 323/315 |
| 4,897,596 | 1/1990 | Hughes et al. | 323/315 |
| 5,012,133 | 4/1991 | Hughes | 307/352 |

FOREIGN PATENT DOCUMENTS

| | | |
|---|---|---|
| 0378452 | 7/1990 | France . |
| 2209254 | 5/1989 | United Kingdom . |

*Primary Examiner*—Emanuel T. Voeltz
*Assistant Examiner*—Ben Davidson
*Attorney, Agent, or Firm*—Oblon, Spivak, McClelland, Maier & Neustadt

[57] ABSTRACT

Disclosed is a current mirror which maintains good performance when the current to be tracked corresponds to a voltage close to the low supply voltage. This current mirror includes a feedback circuit which causes the first transistor of the reference branch of the mirror to track the voltage of the second transistor of the output branch of the mirror.

5 Claims, 2 Drawing Sheets

"PRIOR ART"

"PRIOR ART"

"PRIOR ART"

"PRIOR ART"

CURRENT MIRROR OPERATING UNDER LOW VOLTAGE

BACKGROUND OF THE INVENTION

1. Field of the Invention

The present invention concerns a current mirror electronic circuit, whose architecture was designed with a view to achieving good performance at a low voltage close to the lower voltage supply, and a low conducting resistance. By modifying a known mirror, to which is added a feedback circuit, the output current is held constant regardless of the voltage applied across the terminals of the mirror according to the invention.

The invention can be applied to circuits built with different types of transistors: in order to make the description clearer, the invention will be explained with reference to a circuit consisting of N-MOS transistors, but the scope of the invention is not limited to this.

2. Discussion of the Background

The current mirror is well known in itself in analog electronics, and the basic drawing is shown in FIG. 1. In a very simplified form, between two sources of voltages $V_{DD}$ and $V_{SS}$ are positioned:

a reference branch comprising a current source 1, supplying a current I, and a first transistor T1, a tracking or tracing branch comprising a load 2 and a second transistor T2. The gates of T1 and T2 are connected to each other and to the current source 1, so that the current I' which crosses the load 2 tracks the current I of source 1.

In fact, this type of current mirror has an error (I'=I) due to the transistor gain, especially at low gain. This can be corrected for by creating a Wilson mirror, schematized in FIG. 2, in which a transistor T3 is added on the tracking branch, and its gate is connected to the reference branch, between the source 1 and T1. The transistor T3 receives feedback by means of a simple mirror. In this type of assembly, the voltage excursion of point A, between the load 2 and $T_3$, is limited to a few 100 mV+$V_{GS}$ above the "low" voltage $V_{SS}$. "A few 100 mV" corresponds to the voltage drop across $T_3$, and $V_{GS}$ to the voltage drop across T2.

In the improved Wilson mirror in FIG. 3, a transistor $T_4$ added in the reference branch allows $T_1$ to work under the same conditions as $T_2$, making the circuit symmetrical, because the pair $T_3$, $T_4$ applies the same voltage at points B and C, improving the tracking of the current. However, both types of Wilson mirror have two transistors in series in the tracking branch.

Thus, the two types of Wilson mirror described only work for output voltages (at A) greater than $V_{SS}$+$V_{GS}$+ a few 100 mV, a value which is too high in certain cases, taking into account that, for MOS transistors, $V_{GS}$ can reach values as high as 4 or 5 volts, while the circuits operate at 1 volt.

This limitation is illustrated by the curves in FIG. 4 which show the current/voltage characteristics of a mirror according to different gate/source voltages $V_{GS}$, for the output transistor $T_2$. The dotted curves such as 5 correspond to a simple current mirror (FIG. 1) and the solid line curves correspond to a Wilson current mirror (FIGS. 2 and 3). It can be seen that Wilson mirrors only reach a saturation (and therefore stable) current $I_{DSsat}$ for a value of $V_{DS}$, which, at point (7), is higher than for a simple mirror, (point 8). The arrows 9 show the differences which exist, for a given voltage $V_{GS}$, between a simple mirror and a Wilson mirror: for the latter type, the tracking is better but at the cost of a higher $V_{DSS}$.

$V_{DS}$ or $V_{DSS}$ is called the threshold value, which in former embodiments is much greater than $V_{SS}$ because in the tracking branch there are two transistors T2 and T3 in series, whose conducting resistance $R_{on}$ is too high.

SUMMARY OF THE INVENTION

The purpose of the invention is to obtain a current mirror which can function under a low voltage $V_{DSS}$, greater than the supply voltage $V_{SS}$, so as to be adapted to circuits which themselves operate under a low potential difference between $V_{DD}$ and $V_{SS}$, which does not allow the mirror to operate much above $V_{SS}$.

Another purpose of the invention is to produce a current mirror which has a weak conducting resistance $R_{on}$ in its tracking branch, and this is also a condition required to allow operation at a voltage close to $V_{ss}$.

These purposes are achieved, according to the invention, by means of a simple current mirror, which only has one transistor in its tracking branch but includes voltage feedback, which is particular in that its branch which acts on the mirror's tracking branch is in fact in parallel, and not in series, with the load.

To be more precise, the invention concerns a current mirror operating under low voltage, including, in a reference branch, a current source and a first transistor, and in an output branch, a load and a second transistor, the gates of these two transistors being connected and controlled using the current source, wherein this mirror also includes voltage feedback which, for a voltage close to the lower supply voltage, means that the first transistor has to track, on its drain, the voltage on the drain of the second transistor.

BRIEF DESCRIPTION OF THE DRAWINGS

The invention will be better understood by reading the following detailed description of an example of application, made with reference to the appended figures, which represent.

DESCRIPTION OF THE PREFERRED EMBODIMENT

Figure 1:
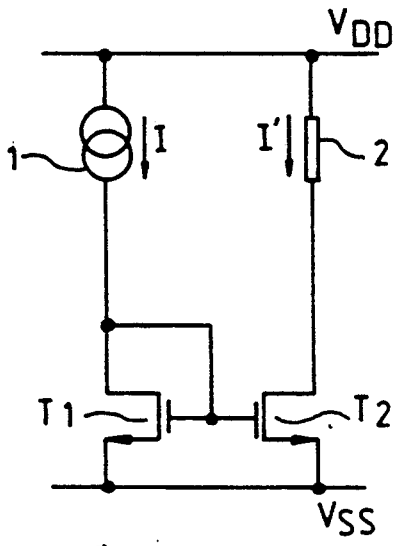
FIGS. 1 to 3: three schematic drawings of known simple and Wilson current mirrors as explained above.
Figure 2:
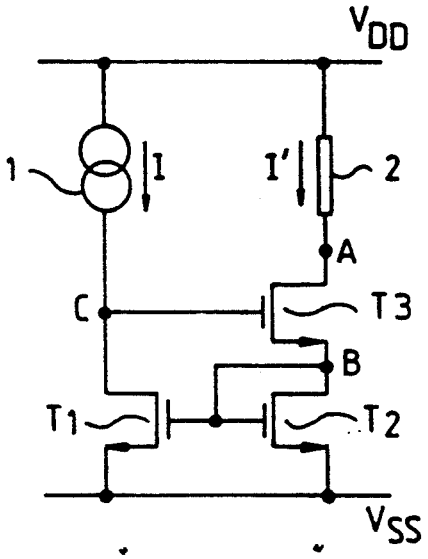
Figure 3:
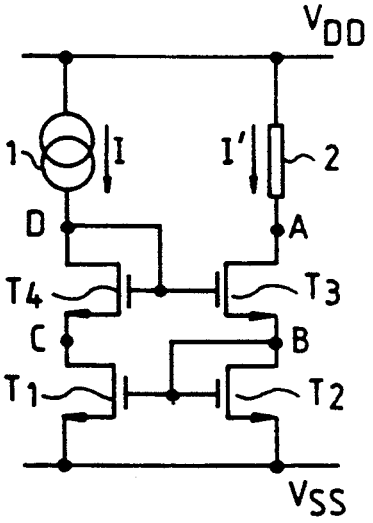
Figure 5:
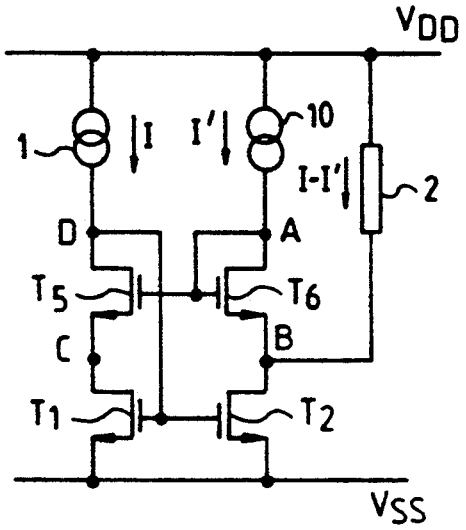
FIG. 5: schematic drawing of a current mirror according to the invention.

FIG. 5 represents the schematic drawing of a current mirror according to the invention. It includes, as its basic part, a simple current mirror for which can be recognized, in comparison with FIG. 1:

a reference branch, comprising a source 1, which supplies a current I, and a first transistor $T_1$.

a tracking branch, comprising a load 2 and a second transistor $T_2$. The common gates of $T_1$ and $T_2$ are controlled from a point D located between the current source 1 and the transistor T2.

The originality of the mirror in FIG. 5 comes from the fact that it also includes a voltage feedback circuit, formed by the transistors $T_5$ and $T_6$. The transistor $T_5$ is mounted on the reference branch of the simple mirror, between the current source 1 (point D) and the transistor $T_1$ (point C). The transistor $T_6$ is mounted in parallel with the load 2, that is to say that its source is connected to point B common to the load 2 and to $T_2$, and that its drain is connected at point A to an auxiliary current source 10. The gates of transistors T5 and T6 are connected, and controlled from point A.

We note the symmetry of the circuit: a first simple mirror 1+T1+T2 gets feedback from a second simple mirror 10+T6+T5, mounted symmetrically so that the tracking branch of one constitutes the reference branch of the other. Only the load 2, mounted in parallel on the current source 10 and T6, breaks the symmetry. It can also be considered that the transistor pair T5 and T6 constitute a voltage tracker which, if neither of the two transistors is blocked, applies the same voltage at points B and C, which means that transistors $T_1$ and $T_2$ of the two branches operate under the same conditions.

If the source 10 supplies a current I', a current I—I' flows in the load 2 since the tracking transistor $T_2$ supplies a total current equal to I. The feedback produced by $T_5$ and $T_6$ makes it possible to keep the output current constant, in the load, when $$V_B - V_{SS} < V_{DSS}(T2)$$

where $V_B$ is the voltage at point B, defined above, and $V_{DSS}(T2)$ is the voltage $V_{DS}$ at saturation for the transistor $T_2$.

The operation of this current mirror is explained by considering the voltage $V_B$ at point B, of which it is supposed that it diminishes progressively from $V_{DD}$ to $V_{SS}$.

Figure 6:
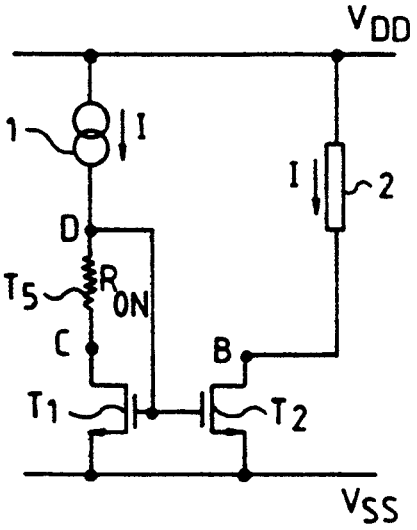
FIG. 6: schematic drawing equivalent to the preceding one but for a high voltage greater than $V_{SS}$.

1. When $V_B = V_{DD}$, $T_6$ is blocked because its $V_{GS}=0$ and point A is drawn towards $V_{DD}$, by the auxiliary source 10. $T_5$ behaves in this case like a conductor switch with low $R_{on}$. In these conditions, the drawing is simplified and becomes that shown in FIG. 6. If the resistance $R_{on}$ of the switch $T_5$ is sufficiently low, it can be neglected, and the drawing of the current mirror according to the invention is equivalent to that of a simple mirror in FIG. 1.

2. When $V_B$ decreases and reaches $$V_B = V_{DD} - V_{DSS}(10) - V_{GS}(T6)$$

($V_{DSS}(10)$ is the drop in voltage in the current source 10, which is itself is made using a transistor), the current I' delivered by the source 10 is reestablished and T6 becomes conducting again. The current through load 2 decreases and becomes I—I'. This decrease of the current in the load 2 is not a disadvantage, because the purpose of the invention is to work very close to the negative supply voltage $V_{SS}$, and not close to the positive supply voltage $V_{DD}$.

3. When $V_B$ continues to decrease, and reaches $$V_B = V_{SS} + V_{DSS}(T2)$$

the transistor pair T5 and T6 behaves like a voltage tracker and tracks the voltage $V_B$ at point C, located between T1 and T5 on the reference branch of the current mirror. This guarantees that the transistors T1 and T2 become ohmic simultaneously.

Figure 7:
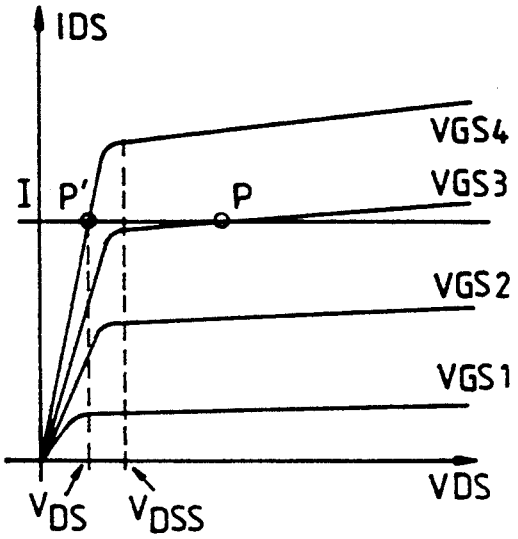
FIGS. 7 and 8: characteristic curves I (V) for a current mirror according to the invention.

Let us consider then the behaviour of T1 in the reference branch, illustrated by FIG. 7. The current source 1 applies a current I, but T5+T6 apply the voltage at point C: the characteristic of T1 moves from point P to point P', in FIG. 7, decreasing because $V_B$ decreases by definition. It follows that the gate voltage of T1 increases from $V_{GS3}$ to $V_{GS4}$, for example. However, by constructing a current mirror, this same voltage $V_{GS4}$ is applied to the gate of T2, and the output current in load 2 remains constant even though the transistor T2 is in ohmic operation, because the point P' is on the linear part of the characteristic I (V).

4. If the voltage $V_B$ continues to decrease, and therefore to approach $V_{SS}$, the gate voltage $V_{GS}$ of T1 continues to increase, but also the voltage $V_D$ of the point D located between the current source 1 and the transistor T5. $V_D$ is drawn to $V_{DD}$ and when it reaches this value, the feedback stops, and the output current decreases. The current generator 1 no longer operates, and neither does the current mirror, but the latter nevertheless continues operating up to a value slightly above $V_{SS}$.

Figure 4:
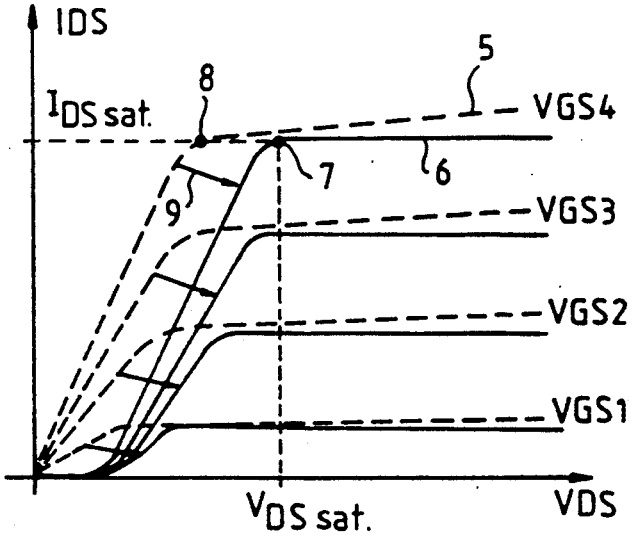
FIG. 4: characteristic curves I (V) for these known mirrors, for several gate voltages.
Figure 8:
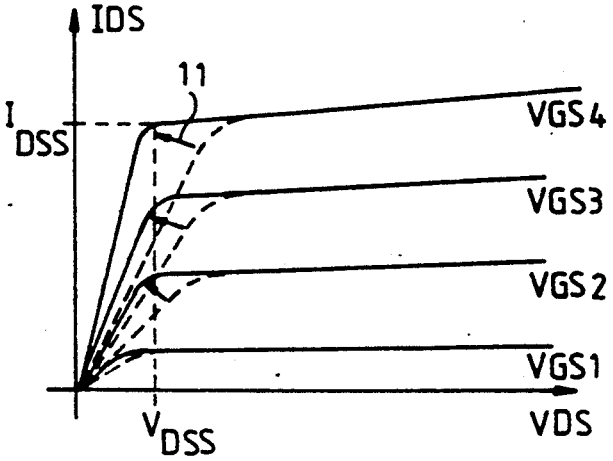

FIG. 8 shows some characteristic curves of the current mirror according to the invention, for 4 different values of $V_{GS}$. In the same figure, the dotted lines show the corresponding curves for a simple current mirror, for the same values of $V_{GS}$. The arrows 11 show the differences which exist between the characteristics of a known mirror (dotted lines) and those of the invention (solid lines). It can be observed that, unlike Wilson mirrors (FIG. 4) for which there is an increase in $V_{DSS}$ in relation to a simple mirror, there is according to the invention a decrease of $V_{DSS}$: the current mirror according to the invention operates at a voltage close to $V_{SS}$, even if $V_{DS}$ of T2 is lower than $V_{DSS}$.

The current mirror according to the invention is used interfaced with circuits operating under low voltage, such as TTL, or as a low resistance switch.

The invention is defined by the following claims.

What is claimed is:

1. A current mirror circuit for operating under low voltage conditions, comprising:

a reference branch comprising a first current source and a first transistor;

an output branch comprising a load and a second transistor;

wherein gates of the first and second transistors are connected to each other and controlled from the first current source;

a feedback branch for causing a drain of the first transistor to track a voltage on a drain of the second transistor, the feedback branch comprising a third transistor inserted between the first current source and the first transistor and a fourth transistor inserted between a second auxiliary current source and the second transistor;

wherein gates of the third and fourth transistors are connected to each other and controlled from the second auxiliary current source.

2. The current mirror circuit according to claim 1, wherein the feedback circuit constitutes a second current mirror, with a tracking branch which controls the reference branch.

3. The current mirror circuit according to claim 1, wherein the feedback branch is mounted in parallel with the load.

4. The current mirror circuit according to claim 3, wherein the output branch has only one transistor.

5. The current mirror circuit according to claim 1, wherein, because of the voltage feedback circuit, the second transistor conserves a characteristic of a saturated drain/source current and a drain/source voltage value lower than the saturation value.

* * * * *